US008491773B2

(12) United States Patent
Szocs et al.

(10) Patent No.: US 8,491,773 B2
(45) Date of Patent: Jul. 23, 2013

(54) METHOD OF REPLENISHING INDIUM IONS IN INDIUM ELECTROPLATING COMPOSITIONS

(75) Inventors: Edit Szocs, Lucerne (CH); Felix J. Schwager, Meggen (CH); Thomas Gaethke, Littau (CH)

(73) Assignee: Rohm and Haas Electronic Materials LLC, Marlborough, MA (US)

( * ) Notice: Subject to any disclaimer, the term of this patent is extended or adjusted under 35 U.S.C. 154(b) by 405 days.

(21) Appl. No.: 12/386,708

(22) Filed: Apr. 22, 2009

(65) Prior Publication Data

US 2010/0032305 A1 Feb. 11, 2010

Related U.S. Application Data

(60) Provisional application No. 61/125,048, filed on Apr. 22, 2008.

(51) Int. Cl.
*C25D 21/18* (2006.01)

(52) U.S. Cl.
USPC ..... 205/101

(58) Field of Classification Search
USPC ..... 205/80–333
See application file for complete search history.

(56) References Cited

U.S. PATENT DOCUMENTS

| | | | | |
|---|---|---|---|---|
| 2,452,361 | A * | 10/1948 | Dyer, Jr. | 205/101 |
| 2,458,839 | A * | 1/1949 | Dyer, Jr. et al. | 205/261 |
| 3,642,589 | A * | 2/1972 | Nobel et al. | 205/242 |
| 3,812,020 | A | 5/1974 | Vander | |
| 3,856,638 | A * | 12/1974 | Bick et al. | 205/249 |
| 3,879,269 | A * | 4/1975 | Bick et al. | 205/268 |
| 3,954,575 | A | 5/1976 | Yanagida et al. | |
| 3,974,045 | A | 8/1976 | Takahashi et al. | |
| 4,038,161 | A | 7/1977 | Eckles et al. | |
| 4,253,920 | A * | 3/1981 | Fletcher et al. | 205/104 |
| 4,396,471 | A * | 8/1983 | Fletcher et al. | 205/250 |
| 4,617,096 | A | 10/1986 | Kuhn et al. | |
| 4,626,324 | A | 12/1986 | Samuels et al. | |
| 4,959,278 | A | 9/1990 | Shimauchi et al. | |
| 5,607,570 | A | 3/1997 | Rohbani | |
| 5,858,196 | A * | 1/1999 | Ikenaga | 205/82 |
| 6,110,347 | A | 8/2000 | Arao et al. | |
| 6,331,240 | B1 | 12/2001 | Tsunoda et al. | |
| 6,406,677 | B1 | 6/2002 | Carter et al. | |

(Continued)

FOREIGN PATENT DOCUMENTS

| | | |
|---|---|---|
| DE | 19643091 | 4/1998 |
| EP | 0 346 888 | 12/1989 |

(Continued)

OTHER PUBLICATIONS

Deppish, et al, "The material optimization and reliability characterization of an indium-solder thermal interface material for CPU packaging," JOM, Jun. 2006, pp. 67-74.

(Continued)

*Primary Examiner* — Luan Van
*Assistant Examiner* — Brian W Cohen
(74) *Attorney, Agent, or Firm* — John J. Piskorski

(57) ABSTRACT

Methods of replenishing indium ions in indium electroplating compositions are disclosed. Indium ions are replenished during electroplating using indium salts of certain weak acids. The method may be used with soluble and insoluble anodes.

6 Claims, 3 Drawing Sheets

U.S. PATENT DOCUMENTS

| | | | | |
|---|---|---|---|---|
| 6,610,192 | B1 | 8/2003 | Step et al. | |
| 6,653,741 | B2 | 11/2003 | Sreeram et al. | |
| 6,811,673 | B2 | 11/2004 | Brodt et al. | |
| 6,911,068 | B2 * | 6/2005 | Cobley et al. | 106/1.25 |
| 2002/0175403 | A1 | 11/2002 | Sreeram et al. | |
| 2003/0022477 | A1 | 1/2003 | Hsieh et al. | |
| 2004/0217009 | A1 * | 11/2004 | Mikkola et al. | 205/296 |
| 2005/0040369 | A1 | 2/2005 | Lalena et al. | |
| 2005/0189231 | A1 | 9/2005 | Capper et al. | |
| 2006/0124454 | A1 * | 6/2006 | Wurm et al. | 204/286.1 |
| 2006/0220226 | A1 | 10/2006 | Renavikar et al. | |
| 2011/0103022 | A1 * | 5/2011 | Szocs et al. | 361/717 |

FOREIGN PATENT DOCUMENTS

| | | | |
|---|---|---|---|
| EP | 1 116 804 | A2 | 7/2001 |
| EP | 2 031 098 | | 3/2009 |
| JP | 57-005857 | A | 6/1980 |
| JP | 57-085987 | A | 11/1980 |
| JP | 57-114653 | A | 1/1981 |
| JP | 57203787 | A | 12/1982 |
| JP | 59-177357 | A | 3/1983 |
| JP | 61-136697 | A | 12/1984 |
| JP | 63-250486 | A | 4/1987 |
| JP | 01-309992 | A | 6/1988 |
| JP | 02-004978 | A | 6/1988 |
| JP | 06-146058 | A | 11/1992 |
| JP | 06-146059 | A | 11/1992 |
| JP | 09-013190 | | 6/1995 |
| JP | 09-176863 | A | 11/1996 |
| JP | 11-279791 | A | 3/1998 |
| JP | 2001-200387 | A | 1/2000 |
| JP | 03-274766 | | 4/2002 |

OTHER PUBLICATIONS

Hua, et al, "Indium as thermal interface material for high power devices," Advancing Microelectronics, Jul./Aug. 2006, pp. 16-17.

Walsh et al.; "Electrode Reactions During the Electrodeposition of Indium From Acid Sulphate Solutions"; Surface Technology, 6 (1978); pp. 425-436.

* cited by examiner

METHOD OF REPLENISHING INDIUM IONS IN INDIUM ELECTROPLATING COMPOSITIONS

The present invention is directed to a method of replenishing indium ions in indium electroplating compositions. More specifically, the present invention is directed to a method of replenishing indium ions in indium electroplating compositions using indium salts of certain weak acids.

Indium is a highly desirable metal in numerous industries because of its unique physical properties. For example, it is sufficiently soft such that it readily deforms and fills in microstructures between two mating parts, has a low melting temperature (156° C.) and a high thermal conductivity (~82 W/mK). Such properties enable indium for various uses in the electronics and related industries; however, indium is a challenging metal to electroplate. Indium electroplating compositions are sensitive to the build-up of additive decomposition products, counter anions and excess indium which typically results in instability of the electroplating composition. When indium electroplating compositions are replenished with indium salts to replace indium ions, both indium ions and the salt's counter anion may reach their solubility limit and accumulate in the compositions. This increases the specific gravity of the compositions. The increase in specific gravity may result in indium deposits with undesirable morphology, i.e., pores, dull and rough surface, and a non-uniform thickness. Typically, the indium ions are replaced with the same indium salt as contained in the original electroplating composition to maintain the same composition components, thus reducing the probability of composition incompatibilities and instabilities.

Indium electroplated using electroplating apparatus with soluble anodes, such as indium soluble anodes, causes an increase in the indium ion concentration beyond optimum levels due to dissolution of indium from the anode and higher anodic current efficiencies than cathodic current efficiencies. This results in indium deposits having undesirable surface morphology and non-uniform thickness. In addition, additives included in the indium composition also may decompose and require replenishment to maintain a stable electroplating composition; however, additive decomposition products are not as serious a problem when electroplating with soluble anodes as with inert anodes.

A wide variety of inert or insoluble anodes are known. Such insoluble anodes include a support material and an active layer. Typically titanium, niobium and lead are used as support material. Such materials are self-passivating under electroplating conditions. The active layer is typically an electron conducting layer, such as platinum, iridium, mixed oxides with platinum metals or diamond. The active layer can be located directly on the surface of the support material but also on a substrate which is attached to the support material at a distance from it.

Inert or insoluble anodes are advantageous over insoluble anodes in many applications where electroplated indium metal is desired. For example, insoluble anodes are advantageous when electroplating indium metal on articles used for thermal interface materials (TIMs). In addition electroplating processes using insoluble anodes are more versatile than processes using soluble anodes, require smaller apparatus, easier maintenance and improved solution flow and agitation. Also, insoluble anodes do not increase the concentration of metal ions in the electroplating composition. However, high anodic over-potential of insoluble anodes causes additives to breakdown. This results in undesirable indium deposits having non-uniform thickness and undesirable surface morphology.

Additionally, the life of the electroplating composition is reduced. The additives included in the indium electroplating compositions are necessary for assisting in the formation of desired indium deposits having the proper matt finish, smoothness, thickness, and other properties desired for an optimum indium deposit.

Regardless of whether indium is being electroplated using soluble or insoluble anodes regular additions of additives based on empirical rules established by workers in the industry to try and maintain optimum concentrations of the additives have been used. However, monitoring the concentrations of the additives is still very difficult because the additives may be present in small concentrations, such as in parts per million. Also the complex mixtures of the additives and the degraded products formed from the additives during electroplating complicate the process. Further, depletion of specific additives is not always constant with time or composition use. Accordingly, the concentration of the specific additives is not accurately known and the level of the additives in the electroplating composition diminishes to a level where the additives are out of the acceptable range.

U.S. Pat. No. 6,911,068 to Cobley et al. discloses electroplating compositions which may be used with insoluble anodes. The patent addresses the problem of additive decomposition in various metal electroplating compositions by introducing one or more unsaturated organic compounds which have been found to inhibit the decomposition of additives. Although there are electroplating compositions which inhibit the decomposition of additives and improve metal electroplating performance, there is still a need for indium electroplating methods for providing improved electroplating composition stability and deposit morphology.

In an aspect a method includes providing a composition including one or more sources of indium ions; electroplating indium on a substrate; and replenishing indium ions in the composition during electroplating with one of more of indium acetate, indium formate and indium oxalate. The method of electroplating indium may be done with soluble or insoluble anodes.

Replenishing indium ions in indium electroplating compositions with the weak acid salts of indium metal maintain a desired specific gravity during indium electroplating and pH. Additionally, replenishing the electroplating compositions with indium ions using the weak acid salts assists in reducing electroplating composition additive decomposition.

The indium electroplating compositions when replenished with the one or more weak acid salts of indium are stable and provide indium metal deposits which have a commercially acceptable morphology, i.e. no pores, smooth and matt surface, a uniform thickness and few, if any, edge defects, i.e. thick deposit build up at the plated substrate sides. Because indium metal has a low melting point and a high thermal conductivity, indium metal is highly suitable for use as thermal interface material in many electrical devices. Further, indium metal dissipates strain induced by CTE mismatch of two mating materials at interfaces, which also makes it desirable for use as a TIM. In addition, the indium metal electroplated from the indium compositions may be used as an underlayer to prevent or inhibit the formation of whiskers. The indium metal may also be used as solder bumps to provide electrical connections.

Figure 3:
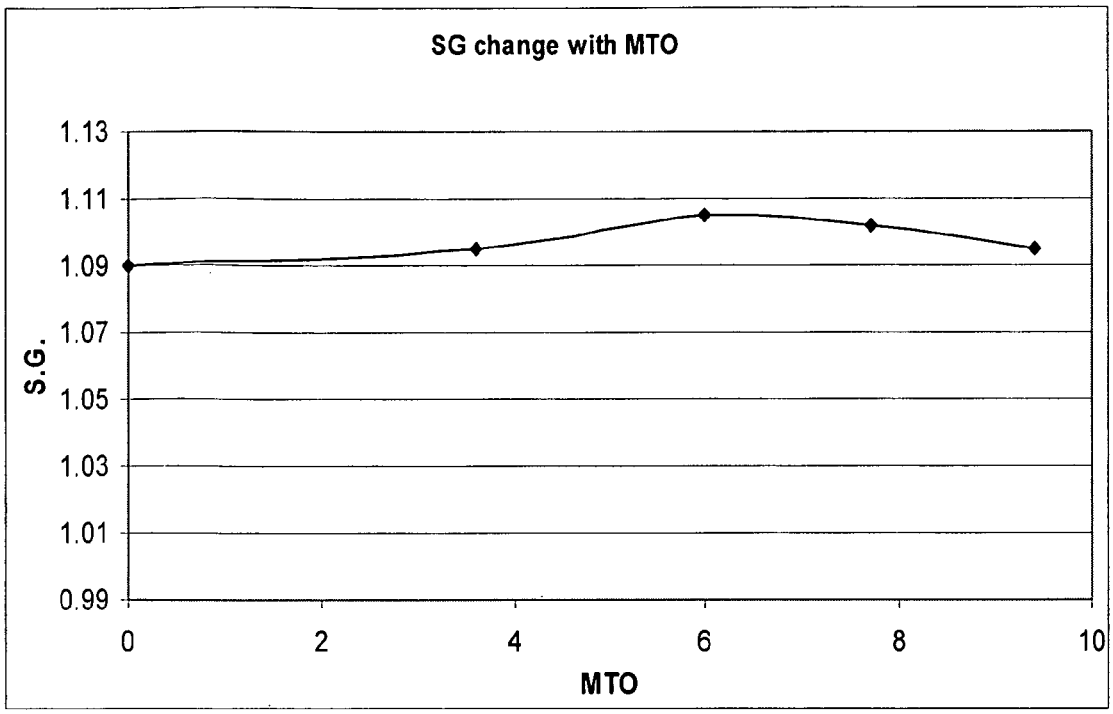

FIG. 3 is a graph of specific gravity versus metal turn over of an indium electroplating composition replenished with indium acetate and indium plating at 2 A/dm$^2$ As used throughout the specification, the following abbreviations have the following meanings, unless the context clearly indicates otherwise: ° C.=degrees Centigrade; K=degrees Kelvin; GPa=giga pascal; S.G.=specific gravity; MTO=metal turnover; matt=flat in appearance, not glossy; g=gram; mg=milligram; L=liter; m=meter; A=amperes; dm=decimeter; μm=micron=micrometer; ppm=parts per million; ppb=parts per billion; mm=millimeter; M=molar; MEMS=micro-electromechanical systems; TIM=thermal interface material; CTE=coefficient of thermal expansion; IC=integrated circuits and EO=ethylene oxide.

The terms "depositing" and "electroplating" and "plating" are used interchangeably throughout this specification. The term "underlayer", as used throughout this specification, refers to a metal layer or coating disposed between a substrate and tin. The term "copolymer" is a compound composed of two or more different mers. All amounts are percent by weight and all ratios are by weight, unless otherwise noted. All numerical ranges are inclusive and combinable in any order except where it is logical that such numerical ranges are constrained to add up to 100%.

Indium electroplating compositions include one or more sources of indium ions which are soluble in an aqueous environment. Such sources include, but are not limited to, indium salts of alkane sulfonic acids and aromatic sulfonic acids, such as methanesulfonic acid, ethanesulfonic acid, butane sulfonic acid, benzenesulfonic acid and toluenesulfonic acid, salts of sulfamic acid, sulfate salts, chloride and bromide salts of indium, nitrate salts, hydroxide salts, indium oxides, fluoroborate salts, indium salts of carboxylic acids, such as citric acid, acetoacetic acid, glyoxylic acid, pyruvic acid, glycolic acid, malonic acid, hydroxamic acid, iminodiacetic acid, salicylic acid, glyceric acid, succinic acid, malic acid, tartaric acid, hydroxybutyric acid, indium salts of amino acids, such as arginine, aspartic acid, asparagine, glutamic acid, glycine, glutamine, leucine, lysine, threonine, isoleucine, and valine. Indium carbonate also may be used as a source of indium ions. Typically, the source of indium ions is one or more indium salts of sulfuric acid, sulfamic acid, alkane sulfonic acids, aromatic sulfonic acids and carboxylic acids. More typically, the source of indium ions is one or more indium salts of sulfuric acid and sulfamic acid.

The water-soluble salts of indium are included in the compositions in sufficient amounts to provide an indium deposit of the desired thickness. Typically the water-soluble indium salts are included in the compositions to provide indium ($3^+$) ions in the compositions in amounts of 5 g/L to 70 g/L, or such as from 10 g/L to 60 g/L, or such as from 15 g/l to 30 g/L.

Buffers or conducting salts included in the indium compositions may be one or more acids to provide a pH of 0 to 5, typically a pH of 0.5 to 3, more typically 0.8 to 1.3. Such acids include, but are not limited to, alkane sulfonic acids, aryl sulfonic acids, such as methanesulfonic acid, ethanesulfonic acid, benzenesulfonic acid, toluenesulfonic acid, sulfamic acid, sulfuric acid, hydrochloric acid, hydrobromic acid, fluoroboric acid, boric acid, carboxylic acids such as citric acid, acetoacetic acid, glyoxylic acid, pyruvic acid, glycolic acid, malonic acid, hydroxamic acid, iminodiacetic acid, salicylic acid, glyceric acid, succinic acid, malic acid, tartaric acid, and hydroxybutyric acid, amino acids, such as arginine, aspartic acid, asparagine, glutamic acid, glycine, glutamine, leucine, lysine, threonine, isoleucine and valine. One or more corresponding salts of the acids also may be used. Typically, one or more alkane sulfonic acids, aryl sulfonic acids and carboxylic acids are used as buffers or conducting salts. More typically, one or more alkane sulfonic acids and aryl sulfonic acids or their corresponding salts are used.

Buffers or conducting salts are used in sufficient amounts to provide the desired pH of the compositions. Typically, the buffers or conducting salts are used in amounts of 5 g/L to 50 g/L, or such as from 10 g/L to 40 g/L, or such as from 15 g/L to 30 g/L of the compositions.

Optionally, one or more hydrogen suppressors are included in the indium compositions to suppress hydrogen gas formation during indium metal deposition. Hydrogen suppressors are compounds which drive the potential for water decomposition, the source of hydrogen gas, to a more cathodic potential such that indium metal may deposit without the simultaneous evolution of hydrogen gas. This increases the current efficiency for indium deposition at the cathode and enables formation of indium layers which are smooth and uniform in appearance and also permits the formation of thicker indium layers than many conventional indium electroplating compositions. This process may be shown using cyclic voltammetry (CV) investigation well known in the art and literature. Aqueous indium electroplating compositions which do not include one or more hydrogen suppressors may form indium deposits that are rough and uneven in appearance. Such deposits are unsuitable for use in electronic devices.

The hydrogen suppressors are epihalohydrin copolymers. Epihalohydrins include epichlorohydrin and epibromohydrin. Typically, copolymers of epichlorohydrin are used. Such copolymers are water-soluble polymerization products of epichlorohydrin or epibromohydrin and one or more organic compounds which includes nitrogen, sulfur, oxygen atoms or combinations thereof.

Nitrogen-containing organic compounds copolymerizable with epihalohydrins include, but are not limited to:

1) aliphatic chain amines;
2) unsubstituted heterocyclic nitrogen compounds having at least two reactive nitrogen sites; and,
3) substituted heterocyclic nitrogen compounds having at least two reactive nitrogen sites and having 1-2 substitution groups chosen from alkyl groups, aryl groups, nitro groups, halogens and amino groups.

Aliphatic chain amines include, but are not limited to, dimethylamine, ethylamine, methylamine, diethylamine, triethyl amine, ethylene diamine, diethylenetriamine, propylamine, butylamine, pentylamine, hexylamine, heptylamine, octylamine, 2-ethylhexylamine, isooctylamine, nonylamine, isononylamine, decylamine, undecylamine, dodecylaminetridecylamine and alkanol amines.

Unsubstituted heterocyclic nitrogen compounds having at least two reactive nitrogen sites include, but are not limited to, imidazole, imidazoline, pyrazole, 1,2,3-triazole, tetrazole, pyradazine, 1,2,4-triazole, 1,2,3-oxadiazole, 1,2,4-thiadiazole and 1,3,4-thiadiazole.

Substituted heterocyclic nitrogen compounds having at least two reactive nitrogen sites and having 1-2 substitutions groups include, but are not limited to, benzimidazole, 1-methylimidazole, 2-methylimidazole, 1,3-diemthylimidazole, 4-hydroxy-2-amino imidazole, 5-ethyl-4-hydroxyimidazole, 2-phenylimidazoline and 2-tolylimidazoline.

Typically, one or more compounds chosen from imidazole, pyrazole, imidazoline, 1,2,3-triazole, tetrazole, pyridazine, 1,2,4-triazole, 1,2,3-oxadiazole, 1,2,4-thiadiazole and 1,3,4-thiadiazole and derivatives thereof which incorporate 1 or 2 substituents chosen from methyl, ethyl, phenyl and amino groups are used to form the epihalohydrin copolymer.

Some of the epihalohydrin copolymers are commercially available such as from Raschig GmbH, Ludwigshafen, Germany and from BASF, Ludwigshafen, Germany or may be made by methods disclosed in the literature. An example of a commercially available imidazole/epichlorohydrin copolymer is Lugalvan™ IZE, obtainable from BASF.

Epihalohydrin copolymers may be formed by reacting epihalohydrins with the nitrogen, sulfur or oxygen containing compounds described above under any suitable reaction conditions. For example, in one method, both materials are dissolved in suitable concentrations in a body of mutual solvent and reacted therein at, for example, 45 to 240 minutes. The aqueous solution chemical product of the reaction is isolated by distilling off the solvent and then is added to the body of water which serves as the electroplating solution, once the indium salt is dissolved. In another method these two materials are placed in water and heated to 60° C. with constant vigorous stirring until they dissolve in the water as they react.

A wide range of ratios of the reaction compound to epihalohydrin can be used, such as from 0.5:1 to 2:1. Typically the ratio is from 0.6:1 to 2:1, more typically the ratio is 0.7 to 1:1, most typically the ratio is 1:1.

Additionally, the reaction product may be further reacted with one or more reagents before the electroplating composition is completed by the addition of indium salt. Thus, the described product may be further reacted with a reagent which is at least one of ammonia, aliphatic amine, polyamine and polyimine. Typically, the reagent is at least one of ammonia, ethylenediamine, tetraethylene pentamine and a polyethyleneimine having a molecular weight of at least 150, although other species meeting the definitions set forth herein may be used. The reaction can take place in water with stirring.

For example, the reaction between the reaction product of epichlorohydrin and a nitrogen-containing organic compound as described above and a reagent chosen from one or more of ammonia, aliphatic amine, and arylamine or polyimine can take place and can be carried out at a temperature of, for example, 30° C. to 60° C. over, for example, 45 to 240 minutes. The molar ratio between the reaction product of the nitrogen containing compound-epichlorohydrin reaction and the reagent is typically 1:0.3-1.

The epihalohydrin copolymers are included in the compositions in amounts of 5 g/L to 100 g/L. Typically, epihalohydrin copolymers are included in amounts of 10 g/L to 80 g/L, more typically, they are included in amounts of 20 g/L to 70 g/L, most typically in amounts of 60 g/L to 100 g/L.

Other optional additives also may be included in the compositions to tailor the compositions to electroplating conditions and to a substrate. Such optional additives include, but are not limited to, one or more of surfactants, chelating agents, levelers, suppressors (carriers), one or more alloying metals and other conventional additives used in indium electroplating compositions.

Any surfactant which is compatible with the other components of the compositions may be used. Typically, the surfactants are reduced foaming or non-foaming surfactants. Such surfactants include, but are not limited to, non-ionic surfactants such as ethoxylated polystyrenated phenol containing 12 moles of EO, ethoxylated butanol containing 5 moles of EO, ethoxylated butanol containing 16 moles of EO, ethoxylated butanol containing 8 moles of EO, ethoxylated octanol containing 12 moles of EO, ethoxylated octylphenol containing 12 moles of EO, ethoxylated/propoxylated butanol, ethoxylated beta-naphthol containing 13 moles of EO, ethoxylated beta-naphthol containing 10 moles of EO, ethoxylated bisphenol A containing 10 moles of EO, ethoxylated bisphenol A containing 13 moles of EO, sulfated ethoxylated bisphenol A containing 30 moles of EO and ethoxylated bisphenol A containing 8 moles of EO. Such surfactants are included in conventional amounts. Typically, they are included in the compositions in amounts of 0.1 g/L to 20 g/l, or such as from 0.5 g/L to 10 g/L. They are commercially available and may be prepared from methods disclosed in the literature.

Other surfactants include, but are not limited to, amphoteric surfactants such as alkyldiethylenetriamine acetic acid and quaternary ammonium compounds and amines. Such surfactants are well known in the art and many are commercially available. They may be used in conventional amounts. Typically they are included in the compositions in amounts of 0.1 g/L to 20 g/L, or such as from 0.5 g/L to 10 g/L. Typically, the surfactants used are quaternary ammonium compounds.

Chelating agents include, but are not limited to, carboxylic acids, such as malonic acid and tartaric acid, hydroxy carboxylic acids, such as citric acid and malic acid and salts thereof. Stronger chelating agents, such as ethylenediamine tetraacetic acid (EDTA) also may be used. The chelating agents may be used alone or combinations of the chelating agents may be used. For example, varying amounts of a relatively strong chelating agent, such as EDTA can be used in combination with varying amounts of one or more weaker chelating agents such as malonic acid, citric acid, malic acid and tartaric acid to control the amount of indium which is available for electroplating. Chelating agents may be used in conventional amounts. Typically, chelating agents are used in amounts of 0.001M to 3M.

Levelers include, but are not limited to, polyalkylene glycol ethers. Such ethers include, but are not limited to, dimethyl polyethylene glycol ether, di-tertiary butyl polyethylene glycol ether, polyethylene/polypropylene dimethyl ether (mixed or block copolymers), and octyl monomethyl polyalkylene ether (mixed or block copolymer). Such levelers are included in conventional amounts. Typically such levelers are included in amounts of 1 ppm to 100 ppm.

Suppressors include, but are not limited to, phenanthroline and its derivatives, such as 1,10-phenantroline, triethanolamine and its derivatives, such as triethanolamine lauryl sulfate, sodium lauryl sulfate and ethoxylated ammonium lauryl sulfate, polyethyleneimine and its derivatives, such as hydroxypropylpolyeneimine (HPPEI-200), and alkoxylated polymers. Such suppressors are included in the indium compositions in conventional amounts. Typically, suppressors are included in amounts of 200 ppm to 2000 ppm.

One or more alloying metals include, but are not limited to, aluminum, bismuth, cerium, copper, gold, magnesium, silver, tin, titanium, zirconium and zinc. Typically the alloying metals are silver, bismuth, tin and zinc. The alloying metals may be added to the indium compositions as water soluble metal salts. Such water soluble metal salts are well known. Many are commercially available or may be prepared from descriptions in the literature. Water soluble metal salts are added to the indium compositions in amounts sufficient to form an indium alloy having 1 wt % to 5 wt %, or such as from 2 wt % to 4 wt % of an alloying metal. Typically, water soluble metal salts are added to the indium compositions in amounts such that the indium alloy has from 1 wt % to 3 wt % of an alloying metal.

Adding one or more alloying metals to indium may alter the properties of indium. Quantities of alloying metals in amounts of 3 wt % or less can improve TIM high temperature corrosion resistance and wetting and bonding to substrates such as silicon chips. Additionally, alloying metals such as silver, bismuth and tin can form low melting point eutectics with indium. Alloying metals may be included in the indium compositions in amounts of 0.01 g/L to 15 g/L, or such as 0.1 g/L to 10 g/L, or such as 1 g/L to 5 g/L.

The indium compositions may be used to electroplate indium metal or indium alloy layers on a substrate. The purity of the indium metal deposit may be as high as 99% by weight or higher unless an alloying metal is included. Layer thickness varies depending on the function of the indium metal or indium alloy layer. In general thicknesses may range from 0.1 μm or more, or such as from 1 μm to 400 μm, or such as from 10 μm to 300 μm, or such as from 20 μm to 250 μm, or such as from 50 μm to 200 μm. Typically, indium metal and indium alloy layers range from 150 μm to 200 μm.

During electroplating indium ions must be replenished to maintain the electroplating cycle. Indium ions in the electroplating compositions are replenished with one or more salts of weak acids of indium acetate, indium tartrate and indium oxalate. Typically, the indium ions are replenished with one or more of indium acetate and indium oxalate. More typically, the indium ions are replenished with indium acetate. Replenishing indium ions with such salts of weak acids prevents or at least reduces turbidity of the electroplating indium composition by inhibiting the change in the S.G. of the electroplating composition during electroplating. In many conventional indium electroplating processes the continuous replenishment of indium ions results in both indium ions and counter-anions reaching their solubility limits. This accumulation of indium ions and counter-anions of the indium salt causes an increase in the S.G. of the electroplating composition and the electroplating composition becomes turbid. When the S.G. increases beyond a certain range, the morphology and thickness of the indium deposit becomes commercially unacceptable. Replenishing the indium electroplating composition with one or more of the weak acid salts of indium provides acceptable S.G. ranges of 1 to 1.2, or such as from 1.05 to 1.18 during electroplating.

In addition to inhibiting the increase in S.G., replenishing indium electroplating compositions with the indium salts of the weak acids reduces additive decomposition in the electroplating compositions and maintains a desired pH range. Such additive decomposition is problematic when indium deposition is done with inert or insoluble electrodes, more typically, with shielded insoluble anodes.

Apparatus used to deposit indium metal and indium alloys on a substrate may be any apparatus for electroplating metals known in the art. Current densities may range from 0.5 A/dm$^2$ to 30 A/dm$^2$, or such as from 1 A/dm$^2$ to 25 A/dm$^2$, or such as from 10 A/dm$^2$ to 20 A/dm$^2$. The substrate on which the indium is to be deposited is the cathode or working electrode. Conventional soluble electrodes may be used as anodes. Typically inert or insoluble anodes are used.

Examples of useful insoluble anodes are anodes that have surfaces with oxides of iridium and tantalum. Other suitable insoluble anodes include, but are not limited to, insoluble anodes of the Group VIII metals of the Periodic Table of Elements, such as cobalt, nickel, ruthenium, rhodium, palladium, iridium and platinum.

Insoluble anodes which include an anode base and a shield as described in U.S. 20060124454 also may be used. The shield may be of metal and corrosion resistant and may be a metal grid, an expanded metal or a perforated plate. Alternatively, the shield may be made of plastic. The anode base has a support material and an active layer. The support material is self-passivating under electroplating conditions. The shield is attached to the anode base at a distance from it and reduces the transport of material to and from the base. The shield may be at a distance of 0.01 mm to 100 mm from the anode base, typically 0.05 mm to 50 mm, more typically 0.1 mm to 20 mm and most typically 0.5 mm to 10 mm.

The temperatures of the indium compositions during indium metal deposition range from 30° C. to 80° C. Typically, the temperatures range from 40° C. to 80° C.

Indium ions may be replenished by any suitable method known in the art including adding the indium salts of the weak acids directly to a container holding the electroplating composition or the indium ions may be replenished through a reservoir. In general, an apparatus for electroplating indium metal includes a container for retaining the indium metal electroplating composition. A substrate (cathode) and one or more anodes are immersed in the indium electroplating composition. The substrate and the anodes are connected electrically to a current source such that the substrate, anodes and electroplating composition are in electrical communication with each other. Instead of regulating the current with the current source, a voltage arrangement, as is well known in the art, may be used to regulate voltage between the substrate and anodes. The indium metal electroplating composition directed continuously to a reservoir by a transporting means such as a pump. The reservoir includes one or more of indium acetate, indium tartrate and indium oxalate as well as additives to replenish indium ions and additives consumed in indium deposition.

The indium compositions may be used to deposit indium metal or indium alloys on various substrates, including components for electronic devices, for magnetic field devices and superconductivity MRIs. The indium compositions may also be used with conventional photoimaging methods to electrochemically deposit indium metal or indium alloy solder bumps on various substrates such as silicon or GaAs wafers.

For example, the indium compositions may be used to electroplate indium metal or an indium alloy on a component for an electrical device to function as a TIM, such as for, but not limited to, ICs, microprocessors of semiconductor devices, MEMS and components for optoelectronic devices. Such electronic components may be included in printed wiring boards and hermetically sealed chip-scale and wafer-level packages. Such packages typically include an enclosed volume which is hermetically sealed, formed between a base substrate and lid, with the electronic device being disposed in the enclosed volume. The packages provide for containment and protection of the enclosed device from contamination and water vapor in the atmosphere outside the package. The presence of contamination and water vapor in the package can give rise to problems such as corrosion of metal parts as well as optical losses in the case of optoelectronic devices and other optical components. The low melting temperature (156° C.) and high thermal conductivity (~82 W/mK) are properties which make indium metal highly desirable for use as a TIM.

Indium TIMs remove heat from processing dies and transfer the heat to lid/heat sinks. The indium TIMs also take up stress induced by the mismatch of the CTE between different materials which are joined together in electronic devices. Indium has a coefficient of thermal expansion of 29 ppm/° C., while silicon and copper are 3 and 17, respectively. The modulus of indium is 10 GPa, while those of the harder silicon and copper are 50 and 130, respectively.

Indium metal or indium alloy layers may be deposited on a surface of a processing die substrate to function as a TIM and a heat sink is joined to the processing die by means of the indium metal or alloy layer. The heat sink may be of a conventional material such as nickel coated copper, silicon carbide or aluminum. The processing die may be joined to a printed wiring board base or ceramic base by means of solder bumps, which are on a side of the processing die opposite to that of the indium metal or alloy layer. The solder bumps may be composed of conventional materials such as tin or tin alloys or other conventional materials used in the electronics industry. The solder bumps also may be of electrochemically deposited indium metal or indium alloy from the compositions described above.

Indium metal or alloy layers may be deposited on a surface of a processing die substrate to function as a TIM and a concave lid (i.e. a top portion with continuous sides perpendicular to the top portion) which covers the processing die and is placed over the die and indium metal or alloy layer. The lid may have a conventional design (i.e. rectangular or elliptical) and may be of conventional materials, such as copper or copper alloy. The indium or alloy layer joins the lid to the die. The processing die is joined to a printed wiring board base or ceramic base by means of solder bumps. Solder bumps at bottom surfaces of the sides of the concave lid join the lid to the printed wiring board base or ceramic base.

Indium metal or indium alloy layers may be deposited on a surface of a heat spreader to function as a TIM. The heat spreader and lid may be of conventional materials, such as copper, copper alloys, silicon carbide or composites of metals and ceramics, such as aluminum infused silicon carbide. The indium metal or indium alloy layer joins the lid to the die.

Indium metal layers may also be deposited on a surface of a processing die substrate to function as a TIM and a concave lid (i.e. a top portion with continuous sides perpendicular to the top portion) which covers the processing die and is placed over the die and indium metal layer. The lid may have a conventional design (i.e. rectangular or elliptical) and may be of conventional materials. The indium layer joins the lid to the die. The processing die is joined to a printed wiring board base or ceramic base by means of solder bumps. Solder bumps at bottom surfaces of the sides of the concave lid join the lid to the printed wiring board base or ceramic base. A second indium metal layer is electrochemically deposited on the top of the lid to function as a second TIM and a heat sink is joined to the top of the lid by means of the second indium metal layer.

In addition to depositing indium and indium alloys on the processing die substrate and heat spreader, indium and indium alloys may be deposited on the lid.

The thickness of the indium metal or alloy layers for TIMs may vary. Typically, the layers are 230 μm or less. More typically, the layers range from 50 μm to 230 μm or such as from 100 μm to 220 μm or such as from 140 μm to 210 μm.

In addition to TIMs, the indium compositions may be used to deposit underlayers on substrates to prevent whisker formation in electronic devices. The substrates include, but are not limited to, electrical or electronic components or parts such as film carriers for mounting semiconductor chips, printed circuit boards, lead frames, contacting elements such as contacts or terminals and plated structural members which demand good appearance and high operation reliability.

Indium metal may be used as an underlayer for tin or tin alloy top layers to prevent or inhibit the formation of whiskers. Whiskers often form when tin or tin alloy layers are deposited on metal materials, such as copper or copper alloys, which compose electrical or electronic components. Whiskers are known to cause electrical shorts resulting in the malfunction of electrical devices. Further, dissipation of strain of CTE mismatch between indium and other metals at the interfaces improves adhesion between the metal layers. Typically, indium underlayers have a thickness of 0.1 μm to 10 μm or such as from 0.5 μm to 5 μm. The tin or tin alloy layers are of conventional thickness.

The following examples further illustrate the invention, but are not intended to limit the scope of the invention.

EXAMPLE I

Comparative

The following aqueous indium composition was prepared:

TABLE 1

| COMPONENT | AMOUNT |
|---|---|
| Indium (3+) ions (from indium sulfate) | 60 g/L |
| Methane sulfonic acid | 30 g/L |
| Imadazole-epichlorohydrin copolymer[1] | 100 g/L |
| Water | To desired volume |
| pH | 1 |

[1]Lugalvan ™ IZE, obtainable from BASF. (IZE contains 48-50 wt % copolymer)

The indium composition was used to deposit an indium layer on a copper board. The indium electroplating composition was maintained at a pH of 1 and a temperature of 60° C. The pH was adjusted with KOH. The S.G. initially was measured to be 1.16. The specific gravity was measured using a conventional aerometer. The composition was continuously agitated during indium metal electroplating. Cathode current density was maintained at 10 A/dm$^2$, and indium deposition rate was 1 μm over 20 seconds. The copper board functioned as the cathode and the anode was a Metakem shielded insoluble anode of titanium and mixed oxide (obtainable from Metakem Gesellschaft fur Schichtchemie der Metalle MBH, Usingen, Germany). During deposition of indium metal, the indium ions were replenished with indium sulfate through out the electroplating cycle to maintain an indium ion concentration of 60 g/L.

Figure 1:
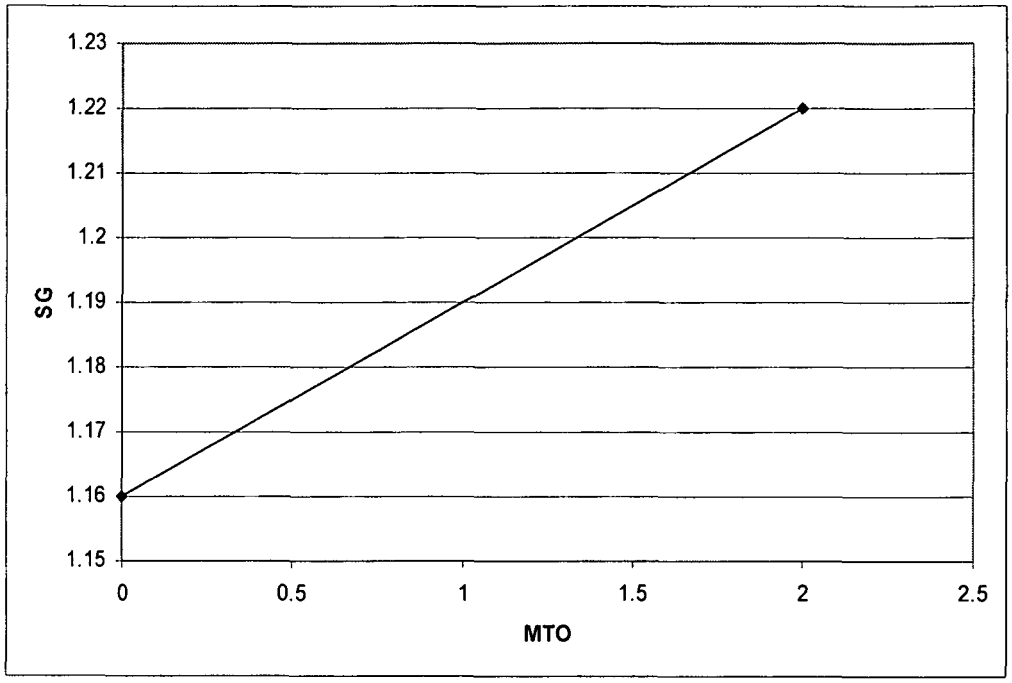
FIG. 1 is a graph of specific gravity versus metal turn over of an indium electroplating composition replenished with indium sulfate and indium plating at 10 A/dm$^2$.

The S.G. of the indium composition was measured at MTOs of 0.5, 1, 1.5 and 2. As shown in FIG. 1 the S.G. continued to increase during the electroplating of indium. The indium composition became turbid due to the increase in the S.G. which was believed to be caused by the accumulation of indium ions and sulfate anions which reached their solubility limit in the electroplating composition. This accumulation of indium ions and sulfate anions was due to the periodic replenishment of indium ions using indium sulfate. The resulting indium deposit had a rough surface. The indium deposit was not uniform and there were pores along the edges of the deposit.

EXAMPLE II

The following aqueous indium electroplating composition was prepared:

TABLE 2

| COMPONENT | AMOUNT |
|---|---|
| Indium ($3^+$) ions (from indium sulfate) | 60 g/L |
| Methane sulfonic acid | 30 g/L |
| Imidazole-epichlorohydrin copolymer[2] | 100 g/L |
| Water | To the desired volume |
| pH | 1 |

[2]Lugalvan ™ IZE, obtainable from BASF. (IZE contains 48-50 wt % copolymer)

The indium composition was used to deposit an indium layer on a copper board. The indium electroplating composition was maintained at a pH of 1 and a temperature of 60° C. The S.G. initially was measured to be 1.165. The composition was continuously agitated during indium metal electroplating. Cathode current density was maintained at 10 A/dm$^2$, and indium deposition rate was 1 μm over 20 seconds. The copper board functioned as the cathode and the anode was a titanium and mixed oxide Metakem shielded insoluble anode. During deposition of indium metal, the indium ions were replenished with indium acetate to maintain an indium ion concentration of 60 g/L.

Figure 2:
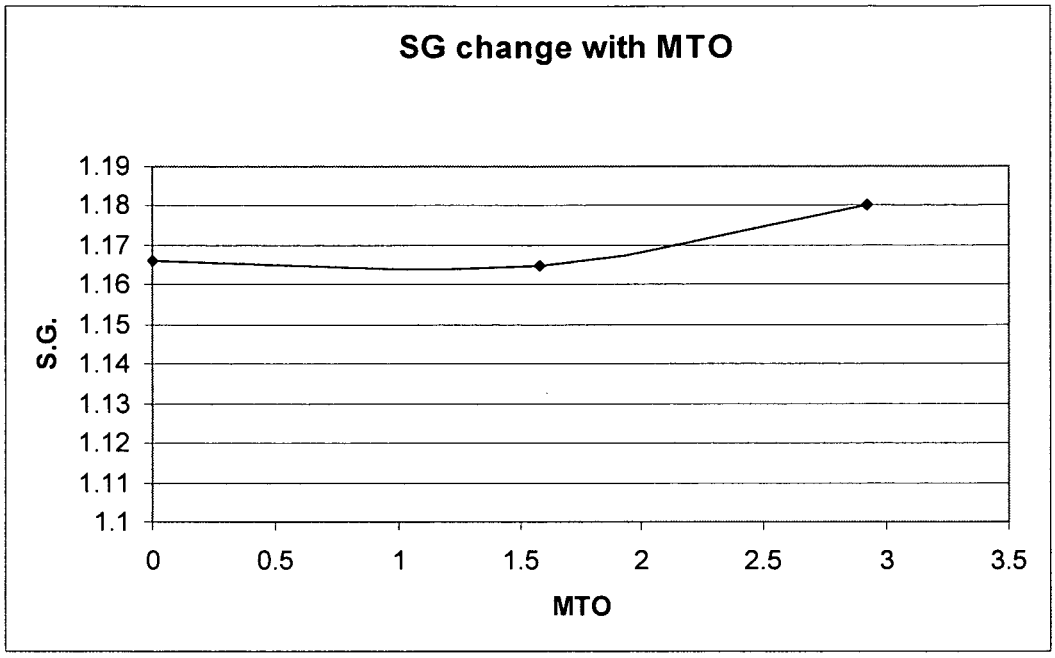
FIG. 2 is a graph of specific gravity versus metal turn over of an indium electroplating composition replenished with indium acetate and indium plating at 10 A/dm$^2$.

The S.G. of the indium composition was measured at MTOs of 0.5, 1, 1.5, 2, 2.5 and 3. As shown in FIG. 2 the S.G. increased slowly during the electroplating of indium in contrast to the S.G. of the indium electroplating composition of Example I where the indium ions were replenished with indium sulfate. The S.G. only increased from 1.165 at MTO=0 to 1.18 at MTO=3. There was no observable turbidity in the indium composition during electroplating. The indium deposit was smooth and matt and there were no observable pores on the edges of the indium deposit. The indium deposit was uniform over the surface of the copper board. Accordingly, replenishing indium ions using indium acetate improved the electroplating performance of the indium composition in contrast to the indium composition where the indium ions were replenished using indium sulfate.

EXAMPLE III

The following aqueous indium electroplating composition was prepared:

TABLE 3

| COMPONENT | AMOUNT |
|---|---|
| Indium ($3^+$) ions (from indium sulfate) | 30 g/L |
| Methane sulfonic acid | 30 g/L |
| Imidazole-epichlorohydrin copolymer[3] | 100 g/L |
| Water | To the desired volume |
| pH | 1 |

[3]Lugalvan ™ IZE, obtainable from BASF. (IZE contains 48-50 wt % copolymer)

The indium composition was used to deposit an indium layer on a copper board. The indium electroplating composition was maintained at a pH of 1 and a temperature of 60° C. The S.G. initially was measured to be 1.09. The composition was continuously agitated during indium metal electroplating. Cathode current density was maintained at 2 A/dm$^2$, and indium deposition rate was 0.6 μm over one minute. The copper board functioned as the cathode and the anode was a titanium and mixed oxide Metakem shielded insoluble anode. During deposition of indium metal, the indium ions were replenished with indium acetate.

The S.G. of the indium composition was measured at MTOs of 3, 6, 7 and 9. As shown in FIG. 3 the S.G. increased slowly during the electroplating of indium in contrast to the S.G. of the indium electroplating composition of Example I where the indium ions were replenished with indium sulfate. The S.G. only increased from 1.09 at MTO=0 to just above 1.10 at MTO=6 and then decreased to just above 1.09 at MTO=9. There was no observable turbidity in the indium composition during electroplating. The indium deposit was smooth and matt and there were no observable pores on the edges of the indium deposit. The indium deposit was uniform over the surface of the copper board. Accordingly, replenishing indium ions using indium acetate improved the electroplating performance of the indium composition in contrast to the indium composition where the indium ions were replenished using indium sulfate.

EXAMPLE IV

The method described in Example II above is repeated except that indium tartrate is used to replenish the indium ions in the electroplating composition. The S.G. of the indium electroplating composition is expected to remain substantially the same or change slowly during the electroplating cycle. The composition is not expected to become turbid during electroplating. The indium deposit is expected to have a matt and smooth surface appearance and have a uniform thickness. In addition no pores are expected to be seen on the edges of the indium deposit.

EXAMPLE V

The method described in Example II above is repeated except that the epihalohydrin copolymer is a 1,2,3-triazole-epichlorohydrin copolymer prepared by conventional methods known in the art. Indium methane sulfonate is the source of indium ions in the initial composition. The indium ions are replenished with indium oxalate during electroplating. The S.G. of the indium electroplating composition is expected to remain substantially the same or change slowly during the electroplating cycle. The composition is not expected to become turbid during electroplating. The indium deposit is expected to have a matt and smooth surface appearance and have a uniform thickness. In addition no pores are expected to be seen on the edges of the indium deposit.

EXAMPLE VI

The method described in Example II above is repeated except that the epihalohydrin copolymer is a pyridazine-epibromohydrin copolymer prepared by conventional methods known in the art. The initial source of indium ions is from indium sulfamate at a concentration of 60 g/L and the methane sulfonic acid is replaced with sulfamic acid at 60 g/L. The indium ions are replenished with indium oxalate during electroplating. The S.G. of the indium electroplating composition is expected to remain substantially the same or change slowly during the electroplating cycle. The composition is not expected to become turbid during electroplating. The indium deposit is expected to have a matt and smooth surface appearance and have a uniform thickness. In addition no pores are expected to be seen on the edges of the indium deposit.

EXAMPLE VII

The method described in Example II above is repeated except that the epihalohydrin copolymer is a 2-methylimidazole-epibromohydrin copolymer prepared by conventional methods known in the art. Indium acetate is used to replenish the indium ions in the indium composition. The S.G. of the indium electroplating composition is expected to remain substantially the same or change slowly during the electroplating cycle. The composition is not expected to become turbid during electroplating. The indium deposit is expected to have a matt and smooth surface appearance and have a uniform thickness. In addition no pores are expected to be seen on the edges of the indium deposit.

EXAMPLE VIII

The method in Example II above is repeated except the indium electrochemical composition further includes 2 wt % tin sulfate. The current density is maintained at 10 A/dm$^2$ over 30 seconds and an indium/tin metal alloy is deposited on the copper board. Indium oxalate is used to replenish indium ions. The S.G. of the indium electroplating composition is expected to remain substantially the same or change slowly during the electroplating cycle. The composition is not expected to become turbid during electroplating. The indium deposit is expected to have a matt and smooth surface appearance and have a uniform thickness. In addition no pores are expected to be seen on the edges of the indium deposit.

EXAMPLE IX

The method in Example II is repeated except that the indium electrochemical composition further includes 2 wt % of zinc sulfate. The current density is maintained at 10 A/dm$^2$ over 20 minutes and an indium/zinc metal alloy is deposited on the copper board. The indium ions are replenished with indium acetate. The S.G. of the indium electroplating composition is expected to remain substantially the same or change slowly during the electroplating cycle. The composition is not expected to become turbid during electroplating. The indium deposit is expected to have a matt and smooth surface appearance and have a uniform thickness. In addition no pores are expected to be seen on the edges of the indium deposit.

EXAMPLE X

The method in Example II is repeated except that the indium electrochemical composition further includes 1 wt % of copper sulfate pentahydrate. The current density is maintained at 5 A/dm$^2$ over 40 minutes and an indium/copper metal alloy is deposited on the copper board. The S.G. of the indium electroplating composition is expected to remain substantially the same or change slowly during the electroplating cycle. The composition is not expected to become turbid during electroplating. The indium deposit is expected to have a matt and smooth surface appearance and have a uniform thickness. In addition no pores are expected to be seen on the edges of the indium deposit.

What is claimed is:

1. A method comprising:

a) providing an aqueous composition comprising one or more sources of indium ions and one or more epihalohydrin copolymers, the aqueous composition has a pH range of 0-5 and a specific gravity of 1 to 1.2;

b) electroplating indium metal on a substrate; and c) replenishing indium ions in the aqueous composition during electroplating with one or more of indium acetate, indium formate and indium oxalate.

2. The method of claim 1, wherein indium is electroplated on the substrate using an apparatus comprising one or more soluble anodes.

3. The method of claim 1, wherein indium is electroplated on the substrate using an apparatus comprising one or more insoluble anodes.

4. The method of claim 3, wherein the one or more insoluble anodes is a shielded insoluble anode.

5. The method of claim 1, wherein the one or more epihalohydrin copolymers are in amounts of 5 g/L to 100 g/L.

6. The method of claim 1, wherein the specific gravity of the aqueous composition ranges from 1.05 to 1.18.

* * * * *